US009434181B1

(12) United States Patent
Nakamura et al.

(10) Patent No.: US 9,434,181 B1
(45) Date of Patent: Sep. 6, 2016

(54) PRINTING DEVICE AND PRINTING METHOD

(71) Applicant: Roland DG Corporation, Hamamatsu-shi, Shizuoka (JP)

(72) Inventors: Yasutoshi Nakamura, Hamamatsu (JP); Jun Ueda, Hamamatsu (JP)

(73) Assignee: ROLAND DG CORPORATION, Shizuoka (JP)

( * ) Notice: Subject to any disclaimer, the term of this patent is extended or adjusted under 35 U.S.C. 154(b) by 0 days.

(21) Appl. No.: 14/744,343

(22) Filed: Jun. 19, 2015

(51) Int. Cl.
*B41J 3/407* (2006.01)
*B41J 2/01* (2006.01)

(52) U.S. Cl.
CPC ..... *B41J 3/4073* (2013.01); *B41J 2/01* (2013.01)

(58) Field of Classification Search
CPC ..... B41J 3/28; B41J 3/4073; B41J 2/01; B41J 11/008; G01B 11/25
See application file for complete search history.

(56) References Cited

U.S. PATENT DOCUMENTS 6,424,422 B1 * 7/2002 Kamon ..... G01B 11/24 250/559.23
6,654,046 B2 * 11/2003 Eccleshall ..... G01B 11/25 348/61
9,014,433 B2 * 4/2015 Kobayashi ..... G01B 11/00 348/46
2007/0070099 A1 * 3/2007 Beer ..... B41J 2/0456 347/8
2009/0120249 A1 * 5/2009 Gauss ..... B41J 3/28 82/124
2014/0026769 A1 1/2014 Miller
2014/0333946 A1 11/2014 Nakamura

FOREIGN PATENT DOCUMENTS

JP 2007-136764 A 6/2007
WO 2014/207007 A1 12/2014

OTHER PUBLICATIONS

Official Communication issued in corresponding European Patent Application No. 15172896.1 mailed on Dec. 1, 2015.

* cited by examiner

*Primary Examiner* — Anh T. N. Vo
(74) *Attorney, Agent, or Firm* — Keating and Bennett, LLP

(57) ABSTRACT

A printing device includes a table that allows a plurality of printing subjects to be placed thereon, a projection device that projects a binary pattern to the printing subjects placed on the table, an image capturing device that captures an image of the printing subjects having the binary pattern projected thereon, a three-dimensional information acquirer that acquires a spatial code image from the image captured by the image capturing device and acquires three-dimensional information on the printing subjects from the acquired spatial code image, a recognizer that recognizes a position and a posture of each of the printing subjects from the acquired three-dimensional information, a disposer that disposes a printing image on each of the printing subjects in accordance with the position and posture thereof, and a printing data generator that generates printing data on the printing image disposed on each of the printing subjects.

12 Claims, 13 Drawing Sheets

PRINTING DEVICE AND PRINTING METHOD

BACKGROUND OF THE INVENTION

1. Field of the Invention

The present invention relates to a printing device and a printing method.

2. Description of the Related Art

Conventionally, so-called flatbed-type printing devices are known. In a flatbed-type printing device, a printing head is moved, for example, in two directions perpendicular to each other in a plane with respect to a printing subject placed on a table. Such a flatbed-type printing device is used for performing printing on, for example, a printing subject such as a substantially rectangular business card, greeting card or the like. In the following description, the term "printing subject" is a "substantially rectangular sheet-type or plate-type printing subject such as a substantially rectangular business card, greeting card or the like", unless otherwise specified.

For performing printing on a printing subject by use of a flatbed-type printing device, the printing subject is placed on a table and then printing is performed. For accurate printing, the printing subject needs to be placed accurately at a predetermined position. This requires, for example, measuring the size of the printing subject beforehand, so that the position at which the printing subject is to be placed is determined accurately.

Such a work needs to be performed accurately. For an unexperienced operator, the work is time-consuming. This causes a problem that the printing requires a long time and the production cost is raised. There is also a problem that the work requires a great number of steps to be performed by an operator, which imposes a heavy load on the operator.

A technology for solving these problems is proposed by, for example, Japanese Laid-Open Patent Publication No. 2007-136764. According to the technology disclosed in Japanese Laid-Open Patent Publication No. 2007-136764, a jig that can be secured to a table and accommodate a plurality of printing subjects is produced. For performing printing, the jig is secured to the table and a plurality of printing subjects are accommodated in the jig, and each of the plurality of printing subjects is accommodated at a predetermined position in the jig. This allows the printing to be performed at predetermined positions of the printing subjects.

However, the above-described technology requires producing a jig in accordance with the shape or the size of a printing subject. This causes a problem that the production of a jig is time-consuming, which imposes a heavy load on the operator. In addition, even in the case where printing is to be performed on a small number of printing subjects, a jig needs to be produced. This increases the cost.

SUMMARY OF THE INVENTION

Preferred embodiments of the present invention provide a printing device and a printing method capable of performing printing easily at a desired position of a printing subject at low cost with no use of a jig, without imposing a heavy load on an operator.

A printing device according to a preferred embodiment of the present invention is a printing device that acquires three-dimensional information on at least one printing subject having a three-dimensional shape and prints a predetermined printing image as a two-dimensional image on the at least one printing subject. The printing device includes a table that allows at least one printing subject to be placed thereon; a projection device that projects a predetermined pattern to the at least one printing subject placed on the table; an image capturing device that captures an image of the at least one printing subject having the predetermined pattern projected thereon; a three-dimensional information acquirer that acquires a spatial code image from the image captured by the image capturing device and acquires the three-dimensional information on the at least one printing subject from the acquired spatial code image; a recognizer that recognizes a position and a posture of each of the at least one printing subject from the acquired three-dimensional information; a disposer that disposes the printing image on each of the at least one printing subject by use of the position and the posture thereof; and a printing data generator that generates printing data representing the printing image disposed by the disposer.

A printing method according to another preferred embodiment of the present invention is a method by which three-dimensional information on at least one printing subject having a three-dimensional shape that is placed on a table is acquired, and a predetermined printing image as a two-dimensional image is printed on the at least one printing subject. The printing method includes projecting a predetermined pattern to the at least one printing subject placed on the table; capturing an image of the at least one printing subject having the predetermined pattern projected thereon; acquiring a spatial code image from the captured image, and acquiring the three-dimensional information on the at least one printing subject from the acquired spatial code image; recognizing a position and a posture of each of the at least one printing subject from the acquired three-dimensional information; disposing the printing image on each of the at least one printing subject by use of the position and the posture thereof; and generating printing data on the printing image disposed on the at least one printing subject.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, examples of preferred embodiments of a printing device and a printing method according to the present invention will be described in detail with reference to the attached drawings. In the figures, letters F, Re, L, R, U and D respectively represent front, rear, left, right, up and down. In the following description, the directions "front", "rear", "left", "right", "up" and "down" are provided for the sake of convenience, and do not limit the manner in which the printing device is installed in any way.

Figure 1:
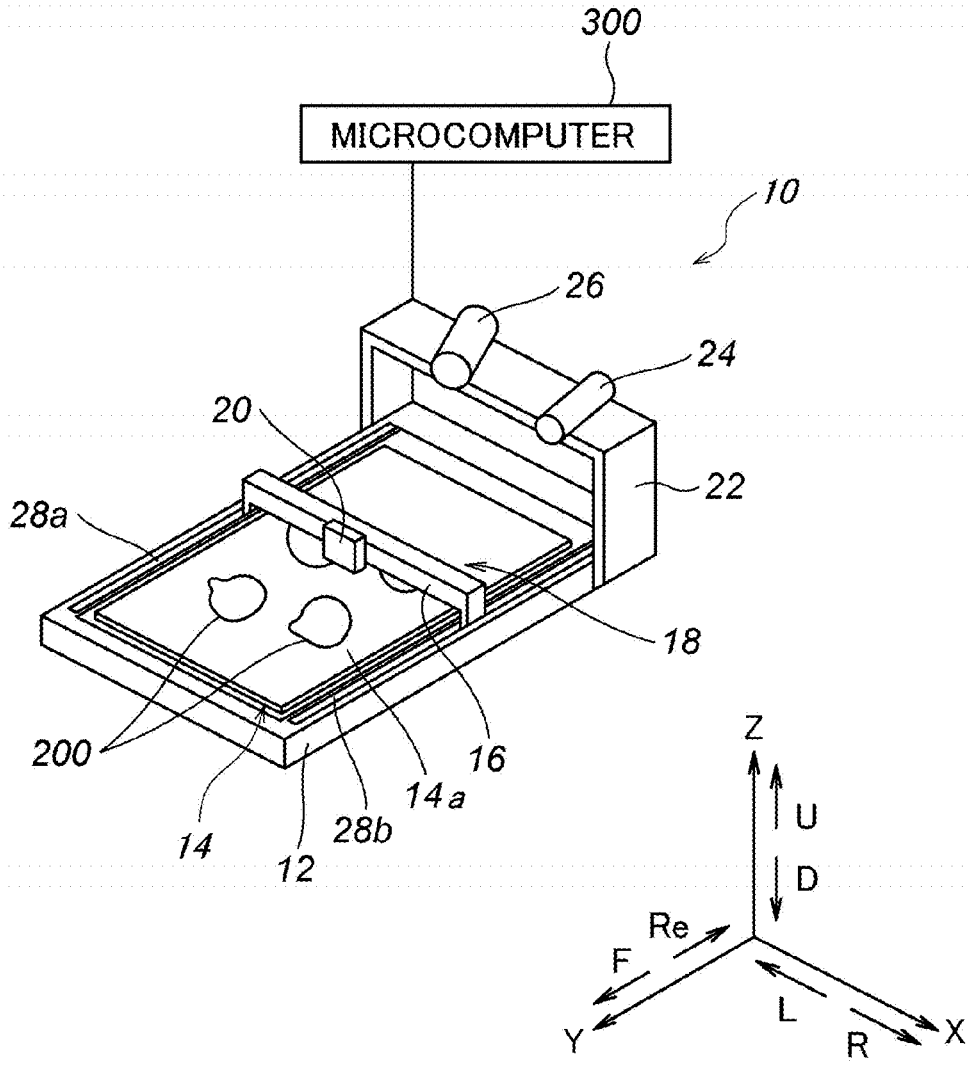
FIG. 1 shows a schematic structure of a printing device according to a preferred embodiment of the present invention.
Figure 2:
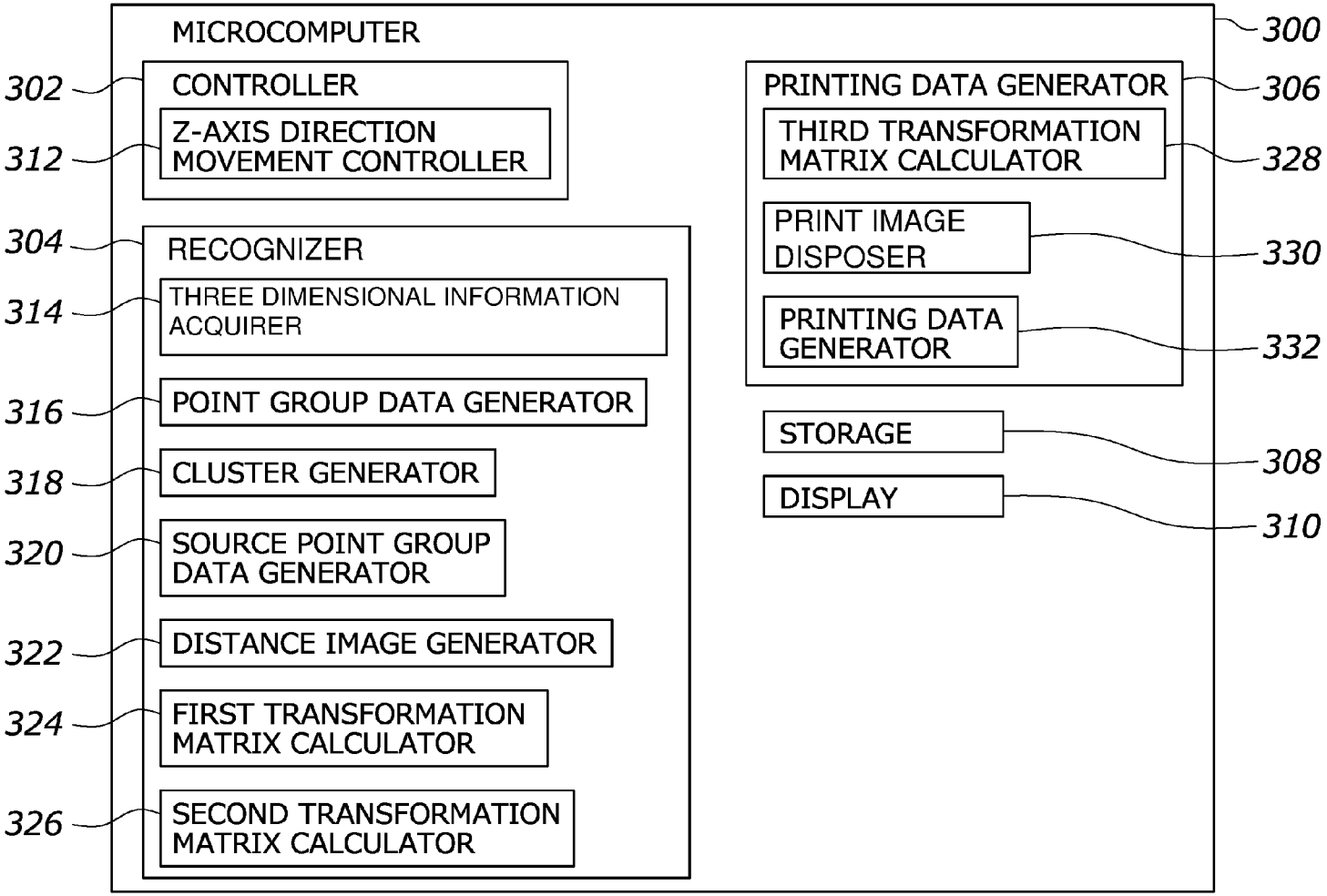
FIG. 2 is a block diagram showing a functional structure of a microcomputer.

First, a structure of a printing device 10 will be described. As shown in FIG. 1, the printing device 10 is a so-called flatbed-type inkjet printer. The printing device 10 includes a base member 12, a table 14 including a top surface 14*a*, a movable member 18 including a rod-shaped member 16, a printing head 20, a standing member 22 standing on a rear portion of the base member 12, a projector 24, a camera 26, and a microcomputer 300. An overall operation of the printing device 10 is controlled by the microcomputer 300. A structure of the microcomputer 300 will be described later.

The table 14 is located on the base member 12. The top surface 14*a* of the table 14 is flat. A printing subject 200 is to be placed on the top surface 14*a* of the table. The table 14 is movable in a Z-axis direction by a moving mechanism (not shown). This allows the printing subject 200 placed on the top surface 14*a* of the table 14 to be moved in the Z-axis direction. The range in which the table 14 is movable up and down matches, for example, a range of thickness of the printing subject 200 on which printing can be performed by the printing device 10. The moving mechanism that moves the table 14 in the Z-axis direction may be a known mechanism, for example, a combination of a gear and a motor. An operation of the moving mechanism is controlled by the microcomputer 300.

The printing subject 200 is placed on the top surface 14*a* of the table 14. The printing subject 200 may have any shape with which the printing subject 200 can be placed on the table 14 with a predetermined gap from the printing head 20. A printing surface of the printing subject 200 may have any of various shapes, for example, may be flat, curved to be protruded upward, curved to be protruded downward, concaved and convexed with piercing edges, or concaved and convexed without piercing edges. A difference between top and bottom levels of the printing surface is within a maximum difference with which ink may be applied normally to the printing surface by the printing head 20.

The base member 12 is provided with guide grooves 28*a* and 28*b* extending in a Y-axis direction. The movable member 18 is driven by a driving mechanism (not shown) to move in the Y-axis direction along the guide grooves 28*a* and 28*b*. There is no limitation on the driving mechanism that moves the movable member 18 in the Y-axis direction. The driving mechanism may be a known mechanism such as, for example, a combination of a gear and a motor. The rod-shaped member 16 extends in an X-axis direction above the table 14. A Z axis is a vertical axis, an X axis is perpendicular to the Z axis, and a Y axis is perpendicular to the X axis and the Z axis.

The printing head 20 is an ink head that injects ink by an inkjet system. In this specification, the "inkjet system" refers to a printing system of any of various types of conventionally known inkjet technologies. The "inkjet system" encompasses various types of continuous printing systems such as a binary deflection system, a continuous deflection system and the like, and various types of on-demand systems such as a thermal system, a piezoelectric element system and the like. The printing head 20 is structured to perform printing on the printing subject 200 placed on the table 14. The printing head 20 is provided on the rod-shaped member 16. The printing head 20 is provided so as to be movable in the X-axis direction. This will be described in more detail. The printing head 20 is engaged with guide rails (not shown) provided on a front surface of the rod-shaped member 16 and is slidable with respect to the guide rails. The printing head 20 is provided with a belt (not shown) movable in the X-axis direction. The belt is rolled up by a driving mechanism (not shown) and thus is moved. Along with the movement of the belt, the printing head 20 moves in the X-axis direction from left to right or from right to left. There is no limitation on the driving mechanism. The driving mechanism may be a known mechanism such as, for example, a combination of a gear and a motor.

The projector 24 projects a predetermined pattern to the entirety of the top surface 14*a* of the table 14. The projector 24 is secured to the standing member 22. An operation of the projector 24 is controlled by the microcomputer 300. In this preferred embodiment, the projector 24 projects a gray code pattern extending in a vertical direction and a gray code pattern extending in a horizontal direction to the top surface 14*a* of the table 14, and also projects a binary pattern when a phase shift spatial coding method (described later) is used. The "binary pattern" is a projection pattern including a slit-shaped light-transmissive area and a slit-shaped light-non-transmissive area, each having a certain width and extending in a direction perpendicular to a width direction, located alternately and repeatedly.

The camera 26 is secured to the standing member 22. The camera 26 is located so as to capture an image of the entirety of the top surface 14*a* of the table 14 in a direction different from a direction in which the projector 24 projects the patterns. An operation of the camera 26 is controlled by the microcomputer 300.

The microcomputer 300 controls the overall operation of the printing device 10 as described above, and also recognizes the position or posture of each of a plurality of printing subjects 200 placed on the table 14 to generate printing data usable to print a printing image, input by an operator, at a predetermined position of each printing subject 200. In this preferred embodiment, the posture of the printing subject 200 is a three-dimensional inclination. As the microcomputer 300, a known microcomputer including, for example, a CPU, a ROM and a RAM is usable. There is no specific limitation on the hardware structure of the microcomputer 300. Software is either stored or read into the microcomputer 300, and the microcomputer 300 executes the software to define and operate as each of the functional elements described below.

The microcomputer 300 includes a controller 302 that controls the overall operation of the printing device 10, a recognizer 304 that recognizes the position or posture of each of the plurality of printing subjects 200 placed on the table 14, a printing data generator 306 that generates printing data usable to perform printing on the plurality of printing subjects 200, a storage 308 that stores the generated printing data and various other types of information, and a display 310 that causes images of the plurality of printing subjects 200 placed on the table 14 and various other images to be displayed on a display screen (not shown).

The controller 302 drives the moving mechanism (not shown) to control various operations, for example, to control the printing head 20 to move in the X-axis direction, to control the movable member 18 to move in the Y-axis direction, and to move the table 14 in the Z-axis direction. The movement of the table 14 in the Z-axis direction is controlled by a Z-axis direction movement controller (adjustment unit) 312 of the controller 302. The Z-axis direction movement controller 312 acquires height information (Z coordinate value) on the greatest height of the printing subjects 200 from three-dimensional information on the printing subjects 200 acquired by the recognizer 304, and controls the table 14 to move up and down based on the height information.

The recognizer 304 includes a three-dimensional information acquirer 314, a point group data generator 316, a cluster generator 318, a source point group data generator 320, a distance image generator 322, a first transformation matrix calculator 324, and a second transformation matrix calculator 326.

The three-dimensional information acquirer 314 acquires three-dimensional information on the printing subjects 200 placed on the table 14. The point group data generator 316 generates point group data on the printing subjects 200 from the acquired three-dimensional information. The cluster generator 318 generates a plurality of clusters representing the printing subjects 200 from the point group data. The source point group data generator 320 sets each of the generated clusters as target point group data, and generates source point group data from one piece of data among the target point group data. The distance image generator 322 generates a source distance image, which is a two-dimensional image, from the source point group data, and generates a target distance image, which is a two-dimensional image, from the target point group data. This will be described in detail later. The first transformation matrix calculator 324 calculates a first transformation matrix usable to rotate the source distance image by an angle such that the source distance image is closest to the target distance image. The second transformation matrix calculator 326 calculates, from the calculated first transformation matrix, a second transformation matrix usable to make the source point group data and the target point group data to be close to each other more accurately.

Images of a plurality of gray code patterns, projected by the projector 24 to the top surface 14*a* of the table 14 having the plurality of printing subjects 200 placed thereon, are captured by the camera 26. The three-dimensional information acquirer 314 acquires a spatial code image from each of the captured gray code patterns by a known spatial coding method, and synthesizes the acquired spatial code images to acquire the three-dimensional information (point group) on the printing subjects 200.

The three-dimensional information acquirer 314 may acquire the three-dimensional information by a known phase shift spatial coding method instead of the spatial coding method. The phase shift spatial coding method is performed as follows. A binary pattern is projected by the projector 24 while being shifted by a predetermined moving distance, and an image of the binary pattern is captured by the camera 26 each time the binary pattern is shifted. The three-dimensional information acquirer 314 synthesizes the captured images to acquire phase shift code images. In the meantime, images of a plurality of binary patterns projected by the projector 24 to the top surface 14*a* of the table 14 having the plurality of printing subjects 200 placed thereon are captured by the camera 26. The three-dimensional information acquirer 314 acquires a spatial code image from each of the captured binary patterns. The three-dimensional information acquirer 314 acquires three-dimensional information on the printing subjects 200 from the acquired phase shift code images and the acquired spatial code images, in other words, by synthesizing phase shift code values and spatial code values. The three-dimensional information acquired by the phase shift spatial coding method has a higher resolution than that of the three-dimensional information acquired by the spatial coding method. More specifically, the phase shift code values acquired by the phase shift spatial coding method is a value obtained as a result of the spatial code value acquired by the spatial coding method being divided more finely. As a result, the posture of the printing subjects 200 is recognized with higher precision. Acquisition of the three-dimensional information by the spatial coding method is known and will not be described herein. Acquisition of the three-dimensional information by the phase shift spatial coding method may be performed by a technology disclosed in, for example, Japanese Patents Nos. 4944435 and 4874657, and will not be described herein.

Figure 3A:
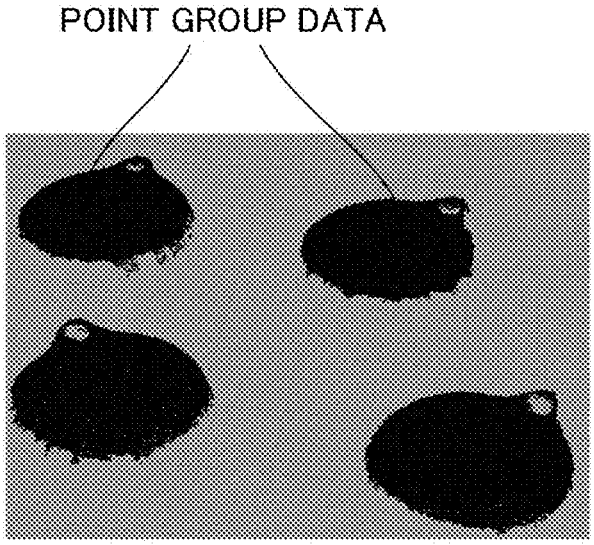
FIG. 3A shows point group data on a plurality of printing subjects.

The point group data generator 316 transforms the three-dimensional information in a camera coordinate system that is acquired by the three-dimensional information acquirer 314 into values in a printing coordinate system. The point group data generator 316 also deletes the point group in the vicinity of (Z=0) on the top surface 14*a* of the table 14 to generate point group data representing only the printing subjects 200 as shown in FIG. 3A. Specifically, the point group data representing only the printing subjects 200 is calculated by the following expression by use of a 4×4 transformation matrix $H_{R2P}$ (described later) calculated by a calibration performed on the camera 26 and the table 14.

$$S\tilde{M}_P = H_{R2P} \cdot \tilde{M}_R \qquad \text{Expression 1}$$

Figure 3B:
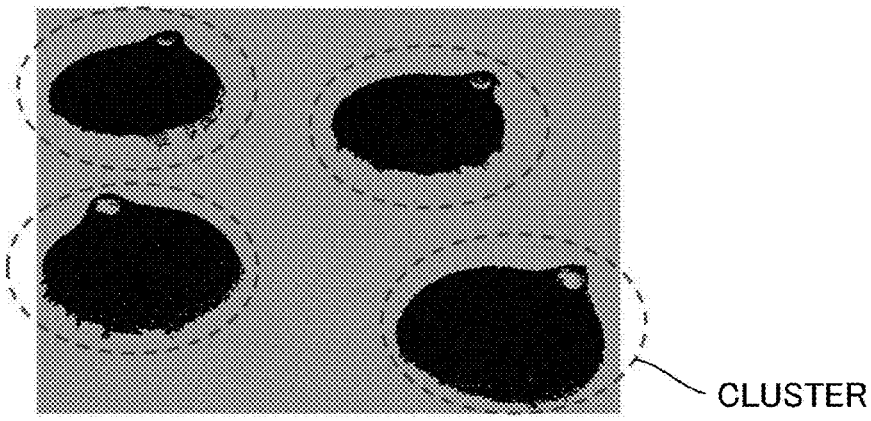
FIG. 3B shows a state where the point group is divided to generate clusters.

As shown in FIG. 3B, the cluster generator (divider) 318 divides the point group data representing the plurality of printing subjects 200 placed on the table 14 into a plurality of pieces of point group data each representing one printing subject 200 by use of the Euclidean Cluster Extraction algorithm to generate clusters each representing each printing subject 200. The Euclidean Cluster Extraction algorithm is a conventionally known technology (R. B. Rusu and S. Cousins, 3D is here: Point Cloud Library (PCL), In IEEE International Conference on Robotics and Automation (ICRA), Shanghai, China, May 9-13, 2011), and will not described herein.

Figure 4A:
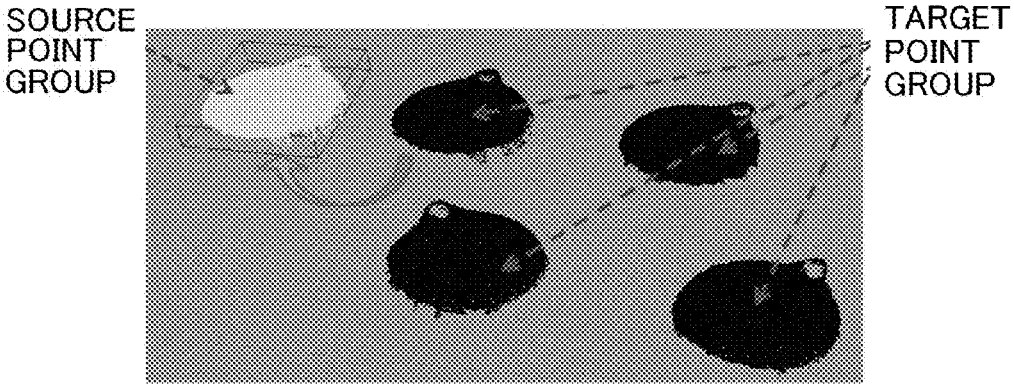
FIG. 4A shows a state where source point group data is generated and target point group data is set.

The source point group data generator (setter) 320 copies one cluster among the plurality of clusters representing the plurality of printing subjects 200, and sets the copied cluster as source point group data. All the plurality of clusters are each set as target point group data. This will be described more specifically, with respect to FIG. 4A. As shown in FIG. 4A, for example, the point group data in an upper left area is copied to generate source point group data, and the four pieces of point group data are each set as target point group data. At this point, the coordinate values of the source point group data are transformed into relative coordinate values from a start point of the display area. In this manner, all the pieces of point group data including the point group data from which the copying was performed are each set as target point group data. Thus, each cluster is made a target at which the printing image is to be disposed. The source point group data may be selected arbitrarily from the plurality of pieces of target point group data.

Figure 4B:
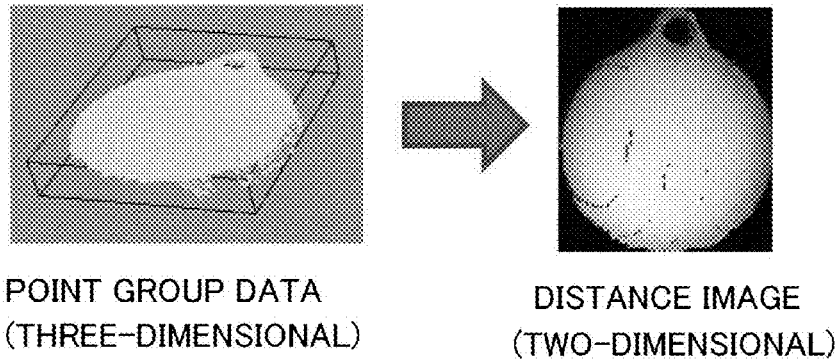
FIG. 4B shows that a distance image is generated from the point group data.

As shown in FIG. 4B, the distance image generator 322 generates a source distance image and a target distance image, each of which is two-dimensional data, respectively from the source point group data and the target point group data generated by the source point group data generator 320. This will be described specifically. In order to generate the source distance image from the source point group data, an X coordinate and a Y coordinate of source point group coordinates, which are three-dimensional coordinates of the source point group data, are transformed into an X coordinate and a Y coordinate, which are two-dimensional coordinates of the source distance image to be generated. In addition, the Z coordinate of the source point group coordinates is represented as a gray value. At this point, the (x, y) coordinates are transformed into values with which an average inter-point distance of the point group data is 1 pixel. In other words, the source distance image is generated by transforming the three-dimensional coordinates of the source point group data into two-dimensional coordinates by the following expression.

$$\begin{bmatrix} u_s \\ v_s \end{bmatrix} = \begin{bmatrix} s & 0 \\ 0 & s \end{bmatrix} \begin{bmatrix} X_s \\ Y_s \end{bmatrix} \quad \text{Expression 2}$$

(Xs, Ys): source point group coordinates (us, vs): source distance image coordinates s: transformation scale from the three-dimensional point group image coordinate system (mm) into the distance image coordinate system The scale factor s usable to transform the coordinate values of the point group data into coordinate values of the distance image is represented as s=reso/25.4 in the case where the resolution of the printer is reso (dpi) and the unit of the coordinate values of the point group data is mm. The range of gray values, i.e., the range from the minimum value to the maximum value among the Z values of the point group data in all the clusters is the range of 0 to 255. In other words, among the gray values, i.e., the Z coordinate values Zs, corresponding to the XY coordinate values of the source point group data, the minimum value is 0, and the maximum value is 255.

In order to generate the target distance image from the target point group data, an X coordinate and a Y coordinate of target point group coordinates, which are three-dimensional coordinates of the target point group data, are transformed into an X coordinate and a Y coordinate, which are two-dimensional coordinates of the target distance image to be generated. In addition, the Z coordinate of the target point group coordinates is represented as a gray value. At this point, the (x, y) coordinates are transformed into values with which an average inter-point distance of the point group data is 1 pixel. In other words, the target distance image is generated by transforming the three-dimensional coordinates of the target point group data into two-dimensional coordinates by the following expression.

$$\begin{bmatrix} u_t \\ v_t \end{bmatrix} = \begin{bmatrix} s & 0 \\ 0 & s \end{bmatrix} \begin{bmatrix} X_t \\ Y_t \end{bmatrix} \quad \text{Expression 3}$$

(Xt, Yt): target point group coordinates (ut, vt): target distance image coordinates s: transformation scale from the three-dimensional point group image coordinate system (mm) into the distance image coordinate system As described above, the scale factor s usable to transform coordinate values of the point group data into coordinate values in the distance image is represented as s=reso/25.4 in the case where the resolution of the printer is reso (dpi) and the unit of the coordinate values of the point group data is mm. The range of gray values, i.e., the range from the minimum value to the maximum value among the Z values of the point group data in all the clusters is the range of 0 to 255. In other words, among the gray values, i.e., the Z coordinate values Zs, corresponding to the XY coordinate values of the target point group data, the minimum value is 0, and the maximum value is 255.

Figure 5A:
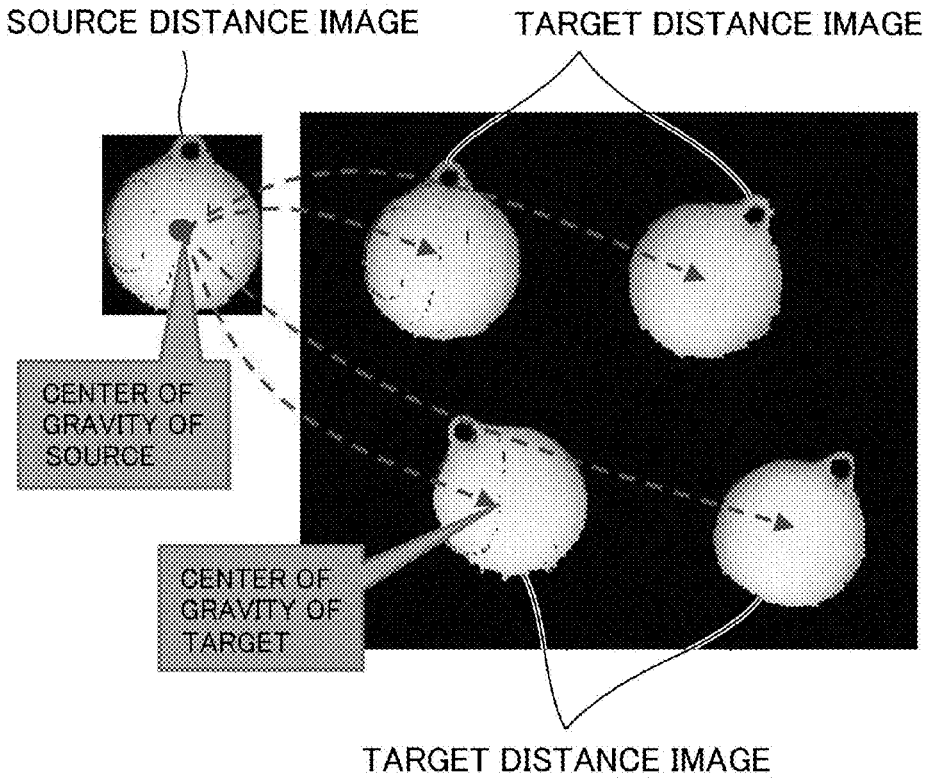
FIG. 5A shows that a source distance image is overlapped on each of target distance images.

As shown in FIG. 5A, the first transformation matrix calculator (first calculator) 324 moves the source distance image generated from the source point group data, such that the center of gravity of the source distance image overlaps the center of gravity of the each of target distance images generated from each piece of the target point group data. The first transformation matrix calculator 324 rotates each of the post-movement source distance images one degree by one degree to acquire a normalized cross correlation for each target distance image. An angle at which the normalized cross correlation is highest is set as the rotation angle of the source distance image. Then, the first transformation matrix calculator 324 calculates a first transformation matrix usable to rotate the source distance image at the above rotation angle on each target distance image. Specifically, an affine transformation matrix Ts usable to move the center of gravity (ugs, vgs) of the source distance image to the origin is represented by the following expression. The first transformation matrix calculator 324 rotates the source distance image one degree by one degree in this example, but the present invention is not limited to this. For example, the first transformation matrix calculator 324 may rotate the source distance image in units of a predetermined degree, for example, two degrees by two degrees, or three degrees by three degrees.

$$T_s = \begin{bmatrix} 1 & 0 & -ugs \\ 0 & 1 & -vgs \\ 0 & 0 & 1 \end{bmatrix} \quad \text{Expression 4}$$

An affine transformation matrix Tt usable to move the source distance image from the origin to the center of gravity (ugtn, vgtn) of each target distance image is represented by the following expression.

$$T_t = \begin{bmatrix} 1 & 0 & ugt \\ 0 & 1 & vgt \\ 0 & 0 & 1 \end{bmatrix} \quad \text{Expression 5}$$

An affine transformation matrix R(θ) usable to rotate the source distance image by angle θ is represented by the following expression.

$$R(\theta) = \begin{bmatrix} \cos\theta & -\sin\theta & 0 \\ \sin\theta & \cos\theta & 0 \\ 0 & 0 & 1 \end{bmatrix} \quad \text{Expression 6}$$

The above-mentioned affine transformation matrices $T_s$, $T_t$ and R(θ) are multiplied to generate a transformation matrix A(θ) (see the following expression). The source distance image is rotated while angle θ is increased one degree by one degree to calculate the transformation matrix A(θ).

$$A(\theta)=T_t \cdot R(\theta) \cdot T_s \quad \text{Expression 7}$$

Then, the coordinate values of the source distance image are transformed by the following expression by use of the calculated A(θ) to acquire the source distance image in a state of being rotated by angle θ.

$$[u'_s\ v'_s\ 1]^T=A(\theta)\cdot[u_s\ v_s\ 1]^T \quad \text{Expression 8}$$

The degree of closeness between the post-coordinate-transformation source distance image (i.e., the source distance image in a state of being rotated by angle θ) and the target distance image is evaluated with a robust normalized cross-correlation coefficient RNCC. The robust normalized cross-correlation coefficient RNCC is represented by the following expression.

$$R_{NCC} = \frac{\sum_{j=0}^{N-1}\sum_{i=0}^{M-1} S(i, j)T(i, j)}{\sqrt{\sum_{j=0}^{N-1}\sum_{i=0}^{M-1} S(i, j)^2 \times \sum_{j=0}^{N-1}\sum_{i=0}^{M-1} T(i, j)^2}} \quad \text{Expression 9}$$

S(i, j): pixel value in the source distance image

T(i. j): pixel value in the target distance image

M: number of pixels in the horizontal direction in the distance image

N: number of pixels in the vertical direction in the distance image

A(θ) at angle θ, among angles θ of 0 to 359, at which the robust normalized cross-correlation coefficient RNCC is greatest is acquired as the first transformation matrix $A_{33}$. The first transformation matrix $A_{33}$ is represented by the following expression. The position at which each printing subject is to be disposed is acquired by acquiring angle θ.

$$A_{33} = \begin{bmatrix} a_{11} & a_{12} & a_{13} \\ a_{21} & a_{22} & a_{23} \\ 0 & 0 & 1 \end{bmatrix} \quad \text{Expression 10}$$

The second transformation matrix calculator (second calculator) 326 calculates, from the first transformation matrix $A_{33}$, a second transformation matrix usable to make the source point group data close to the target point group data with higher precision. The second transformation matrix is calculated for each piece of target point group data. This will be described specifically. The first transformation matrix $A_{33}$ calculated by the first transformation matrix calculator 324 is expanded to a 4×4 matrix usable to perform transformation into three-dimensional coordinates to acquire a transformation matrix $A_{44}$. The transformation matrix $A_{44}$ is represented by the following expression.

$$A_{44} = \begin{bmatrix} a_{11} & a_{12} & 0 & a_{13}/s \\ a_{21} & a_{22} & 0 & a_{23}/s \\ 0 & 0 & 1 & 0 \\ 0 & 0 & 0 & 1 \end{bmatrix} \quad \text{Expression 11}$$

Figure 5B:
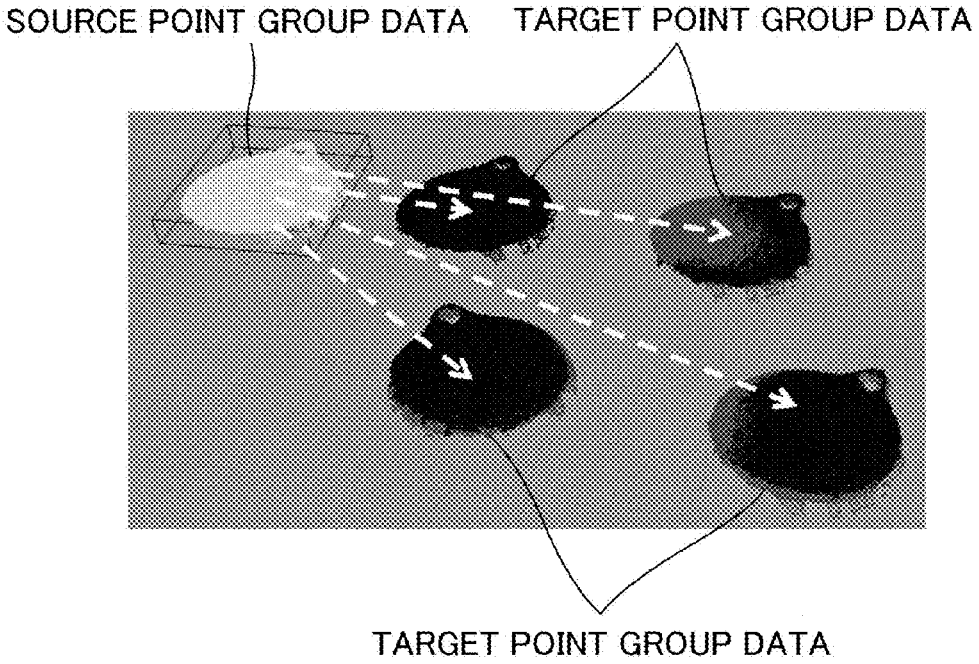
FIG. 5B shows a state where a two-dimensional component of the source point group data is made close to the target point group data.

At this point, translation components $a_{13}$ and $a_{23}$ are transformed by an extent corresponding to the transformation scale s (i.e., scale factor s) usable to perform transformation from the three-dimensional coordinate system to the two-dimensional coordinate system. As represented by the following expression, only the two-dimensional component of the source point group data is transformed by use of the transformation matrix $A_{44}$ to make the source point group data close to the target point group data as shown in FIG. 5B.

$$\begin{bmatrix} X_t \\ Y_t \\ Z_t \\ 1 \end{bmatrix} = A_{44} \begin{bmatrix} X_s \\ Y_s \\ Z_s \\ 1 \end{bmatrix} \quad \text{Expression 12}$$

Then, a transformation matrix $A_{ICP}$ usable to make the source point group data close to the target point group data more accurately is calculated by use of the ICP (Interactive Closest Point) algorithm. The ICP algorithm is a conventionally known technology (Paul J. Besl and Neil D. McKay, A method for registration of 3-d shapes, IEEE Transactions on Pattern Analysis and Machine Intelligence, Vol. 14, No. 2, pp. 239-256, February 1992), and will not be described herein.

Figure 6:
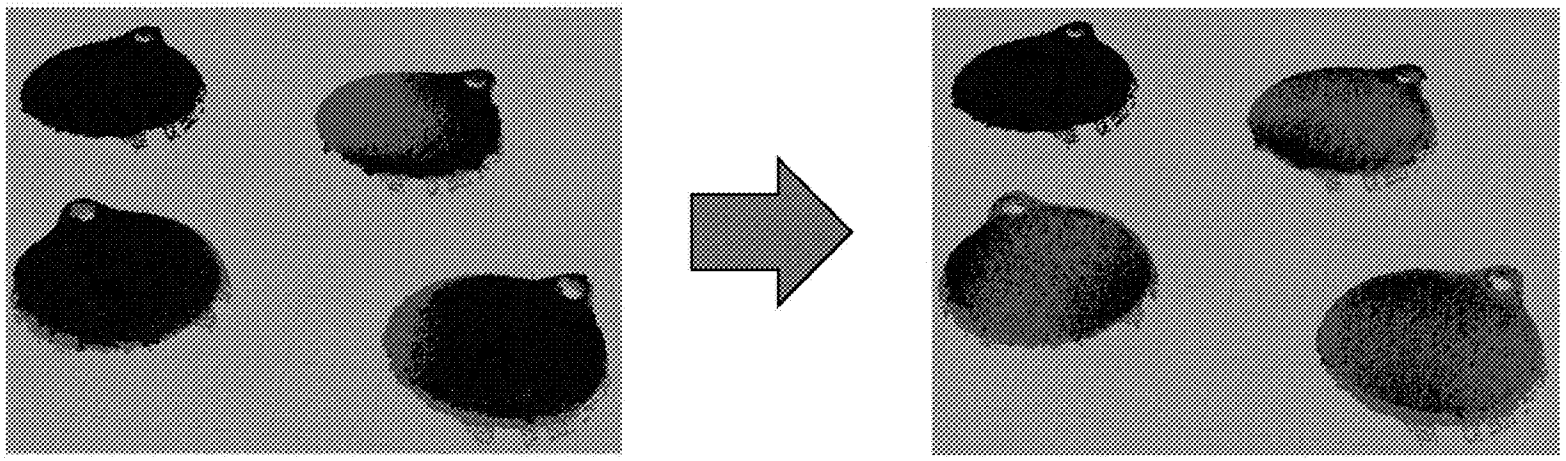
FIG. 6 provides an image showing a state where the two-dimensional component of the source point group data is made close to the target point group data by use of a transformation matrix $A_{44}$, and an image showing that three-dimensional position matching is optimized by use of a transformation matrix $A_{ICP}$.

The transformation matrix $A_{44}$ is an optimal solution among solutions obtained by rotating the source distance image discretely one degree by one degree. Therefore, it is difficult to accurately match the source point group data transformed by use of the transformation matrix to each target point group data. However, the posture of the entire three-dimensional component, which is diverted due to the actual disposing method or the dispersion of the shape, is optimized by the ICP algorithm. As a result, as shown in FIG. 6, more accurate position matching suitable to the actual shape is performed. For performing the optimization by use of the ICP algorithm, the result of transformation of the two-dimensional component of the source point group data performed by use of the transformation matrix $A_{44}$ is set as an initial value. The rough transformation matrix $A_{44}$ and the transformation matrix $A_{ICP}$ calculated by use of the ICP algorithm are multiplied to calculate a second transformation matrix $A_{3D}$ usable to accurately match the source point group data to each target point group data. The second transformation matrix $A_{3D}$ is represented by the following expression.

$$A_{3D}=A_{ICP}\cdot A_{44} \quad \text{Expression 13}$$

Figure 7:
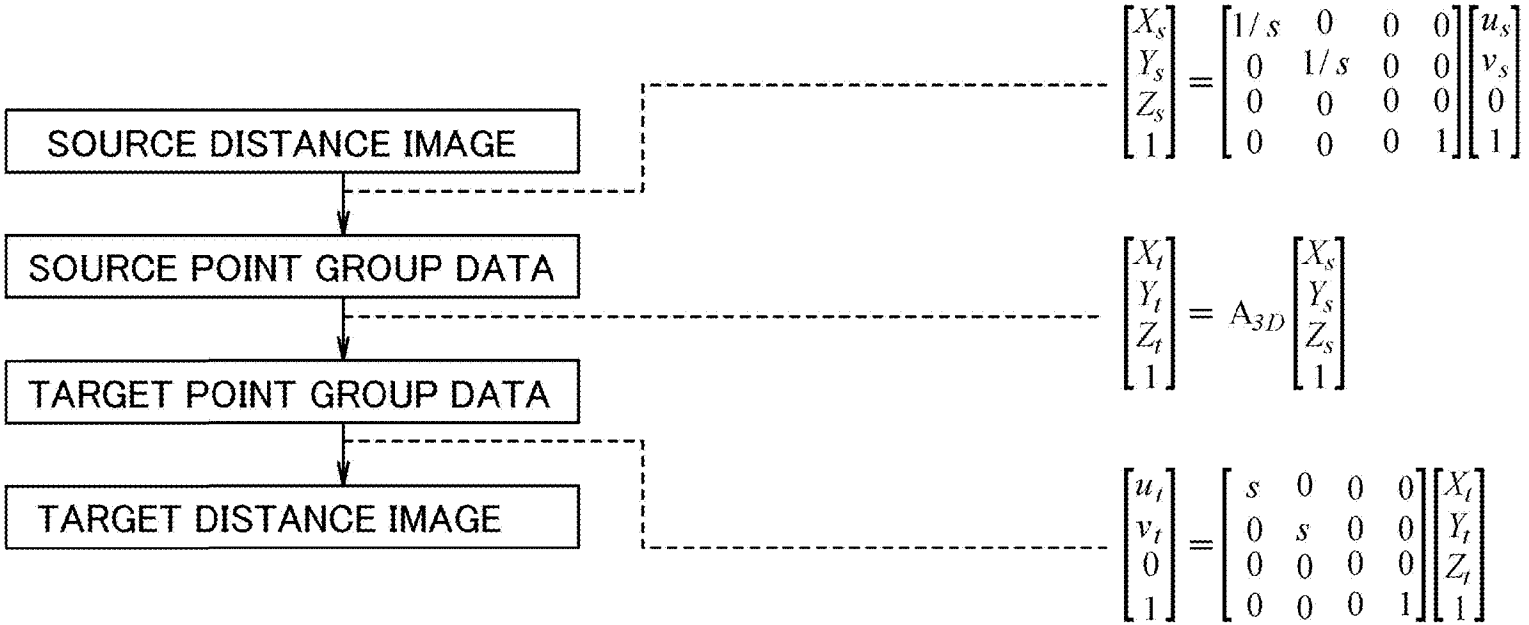
FIG. 7 shows that a source distance image is transformed into a target distance image.

The printing data generator 306 includes a third transformation matrix calculator (third calculator) 328, a printing image disposer (disposer) 330, and a printing data generator 332. The third transformation matrix calculator 328 calculates a third transformation matrix usable to dispose a printing image, input onto the source distance image, on each target distance image. The printing image disposer 330 disposes the printing image, input onto the source distance image, on each target distance image by use of the third transformation matrix. The printing data generator 332 generates printing data based on the printing image disposed on the target distance image. This will be described in more detail. The third transformation matrix calculator 328 calculates the third transformation matrix usable to dispose the printing image, input onto the source distance image by the operator, on each target distance image in accordance with the position or posture of the printing subject 200, by use of the transformation matrix calculated by the second transformation matrix calculator 326. The source distance image, which is a two-dimensional image, is transformed into the target distance image, which is also a two-dimensional image, as follows. As shown in FIG. 7, the source distance image is transformed into the source point group data, and then the source point group data is transformed into the target point group data. Then, the target point group data is transformed into the target distance image. In other words, in a process of transforming the source distance image into the source point group data, each of pixels in the two-dimensional image is disposed in a three-dimensional space. The three-dimensional coordinates of each pixel are provided by adding Z coordinate=0 to the X coordinate and the Y coordinate of the pixel. At this point, the three-dimensional coordinates of each pixel is acquired by the following expression.

Expression 14

$$\begin{bmatrix} X_s \\ Y_s \\ Z_s \\ 1 \end{bmatrix} = \begin{bmatrix} 1/s & 0 & 0 & 0 \\ 0 & 1/s & 0 & 0 \\ 0 & 0 & 0 & 0 \\ 0 & 0 & 0 & 1 \end{bmatrix} \begin{bmatrix} u_s \\ v_s \\ 0 \\ 1 \end{bmatrix} \quad (1)$$

In a process of transforming the source point group data into the target point group data, the three-dimensional coordinates of the source point group data are transformed into three-dimensional coordinates of the target point group data by the following expression.

Expression 15

$$\begin{bmatrix} X_t \\ Y_t \\ Z_t \\ 1 \end{bmatrix} = A_{3D} \begin{bmatrix} X_s \\ Y_s \\ Z_s \\ 1 \end{bmatrix} \quad (2)$$

This transformation is to be performed on the same table plane (two-dimensional transformation). However, the transformation matrix $A_{ICP}$ includes slight movement or rotation in the Z axis direction (three-dimensional coordinate transformation) due to a slight error in the shape or position of each actual printing subject 200. In a process of transforming the target point group data into the target distance image, the two-dimensional image is generated from the three-dimensional coordinates of the target point group data by the following expression.

Expression 16

$$\begin{bmatrix} u_s \\ v_s \\ 0 \\ 1 \end{bmatrix} = \begin{bmatrix} s & 0 & 0 & 0 \\ 0 & s & 0 & 0 \\ 0 & 0 & 0 & 0 \\ 0 & 0 & 0 & 1 \end{bmatrix} \begin{bmatrix} X_t \\ Y_t \\ Z_t \\ 1 \end{bmatrix} \quad (3)$$

As described above, the movement or rotation in the Z axis direction is performed in the process of transforming the source point group data into the target point group data. Therefore, there occurs a case where the post-transformation Z coordinate is not "0". In this case, the Z coordinate is forcibly made "0", so that the shape is projected to the Z=0 plane. The above-described three-stage transformation (transformations by expressions 14 through 16) may be summarized as follows.

Expression 17

$$\begin{bmatrix} u_t \\ v_t \\ 0 \\ 1 \end{bmatrix} = \begin{bmatrix} s & 0 & 0 & 0 \\ 0 & s & 0 & 0 \\ 0 & 0 & 0 & 0 \\ 0 & 0 & 0 & 1 \end{bmatrix} A_{3D} \begin{bmatrix} 1/s & 0 & 0 & 0 \\ 0 & 1/s & 0 & 0 \\ 0 & 0 & 0 & 0 \\ 0 & 0 & 0 & 1 \end{bmatrix} \begin{bmatrix} u_s \\ v_s \\ 0 \\ 1 \end{bmatrix}$$

The three 4×4 transformation matrices may be summarized into one 4×4 matrix as follows.

Expression 18

$$H_{44} = \begin{bmatrix} h_{11} & h_{12} & 0 & h_{14} \\ h_{21} & h_{22} & 0 & h_{24} \\ 0 & 0 & 0 & 0 \\ 0 & 0 & 0 & 1 \end{bmatrix}$$

The above expression represents an affine transformation matrix of the two-dimensional coordinates, and therefore may be represented by a 2×3 matrix as follows. This is set as the third transformation matrix.

Expression 19

$$\begin{bmatrix} u_t \\ v_t \end{bmatrix} = \begin{bmatrix} h_{11} & h_{12} & h_{14} \\ h_{21} & h_{22} & h_{24} \end{bmatrix} \begin{bmatrix} u_s \\ v_s \end{bmatrix}$$

Figure 8:
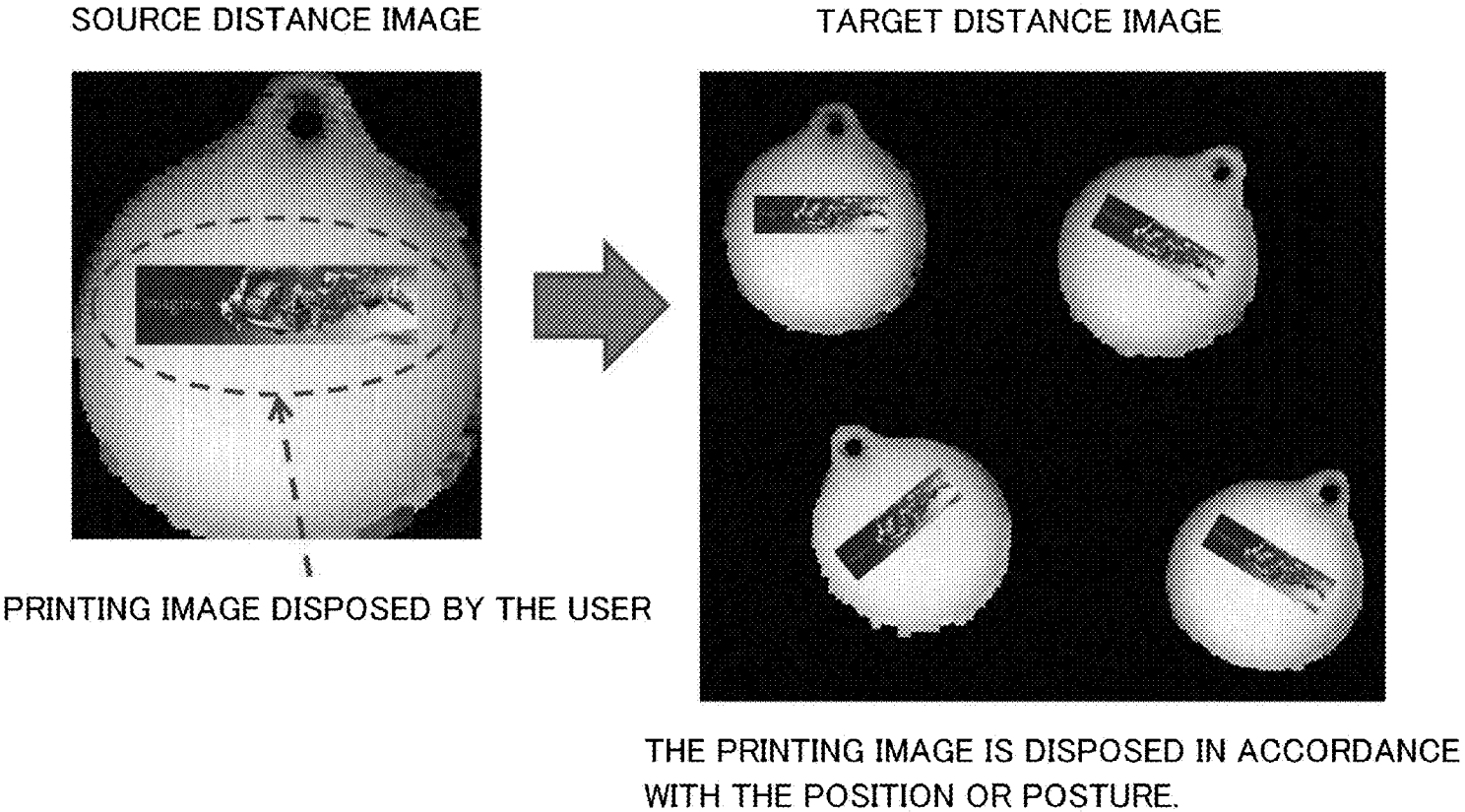
FIG. 8 shows a state where a printing image is disposed on the source distance image and shows a state where the printing image is disposed on each of the target distance images.

As shown in FIG. 8, the printing image disposer 330 transforms the printing image, disposed on the source distance image displayed on the display screen by the operator, by use of the third transformation matrix to dispose the printing image on each target distance image in accordance with the position or posture of the target distance image. More specifically, the printing image is disposed on each target distance image by use of the third transformation matrix, such that the position and posture of the printing image disposed on the source distance image match those of each target distance image. The printing data generator 332 generates printing data based on the printing image disposed on each target distance images by the printing image disposer 330.

The storage 308 stores the printing data generated by the printing data generator 306 and also stores, for example, various types of information necessary to perform the printing on the printing subjects 200. The display 310 causes the display screen to display the images acquired by the recognizer 304 as well as various types of images and information. The display 310 also changes the content to be displayed based on information input by the operator pressing an operation button (not shown).

With the printing device 10 having the above-described structure, desired printing is performed on the printing subjects 200 having a three-dimensional shape as follows. First, camera calibration and calibration on the camera 26 and the top surface 14*a* (printing coordinate system) of the table 14 (hereinafter, referred to as "installation calibration") are performed on the printing device 10 at a predetermined timing, for example, at the time of shipping of the printing device 10 from the plant or at the time of exchange of the camera 26. The camera calibration is performed independently from the printing device 10 by use of a separate LCD (liquid crystal display). After the camera calibration is performed, the camera 26 is installed in the printing device 10, and the installation calibration is performed to find the position relationship and the posture relationship between the camera 26 and the top surface 14*a* of the table 14. This will be described more specifically. In the camera calibration, an image of a checkered pattern is captured in the entirety of the angle of view of the camera 26, and a camera parameter is calculated by use of the Zhang technique. Used as the checkered pattern is not the checkered pattern drawn on the top surface 14*a* of the table 14, but is a checkered pattern displayed on the LCD. A method for calculating the camera parameter by use of the Zhang technique is disclosed in, for example, Japanese Patent No. 4917351 and will not be described herein. Calculated by the camera calibration are a camera inside parameter (Ac), a camera outside parameter ([Rc, Tc]), a projector inside parameter (Ap), and a projector outside parameter ([Rp, Tp]).

Figure 9A:
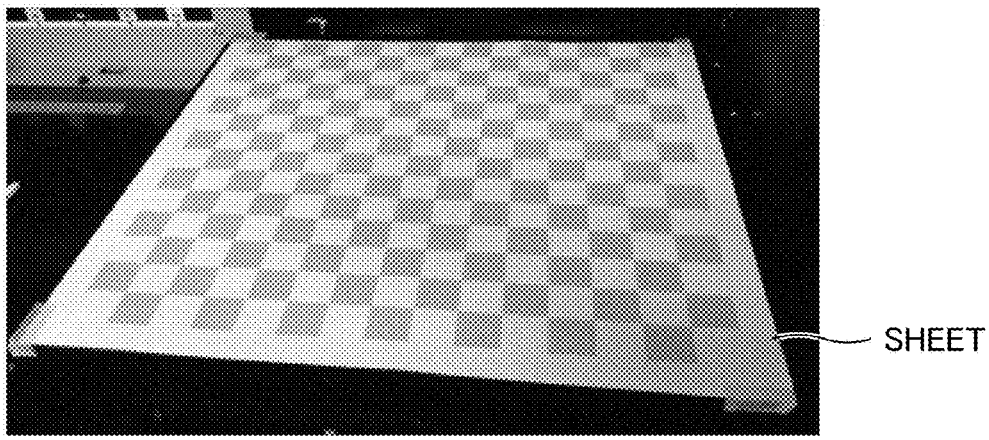
FIG. 9A shows a checker pattern printed on a sheet attached to a table.
Figure 9B:
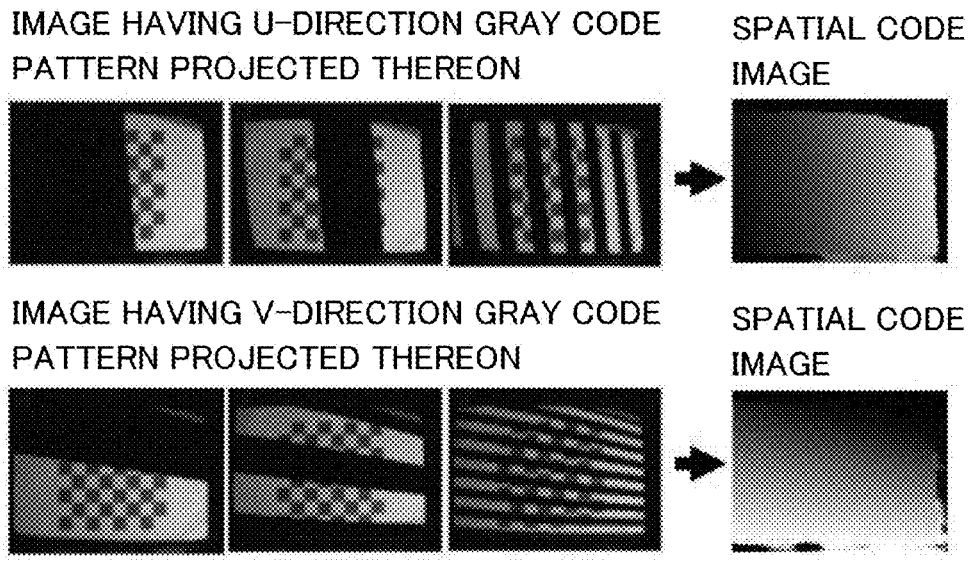
FIG. 9B shows that gray code patterns are projected to the checker pattern to acquire spatial code images.

In the installation calibration, an affine transformation matrix $H_{R2P}$ usable to transform the three-dimensional coordinate system of the camera 26 into the printing coordinate system of the printing device 10 is calculated. First, as shown in FIG. 9A, a sheet is bonded to the top surface 14*a* of the table 14, and a checker pattern showing an actual printing range is printed on the sheet by the printing device 10. For example, each of squares in the checker pattern is gray or white and preferably has a size of 20×20 mm. The checker pattern preferably has an overall size of, for example, 300×280 mm. Next, a gray code pattern extending in a u direction (vertical direction) and a gray code pattern extending in a v direction (horizontal direction) are projected to the sheet having the checker pattern printed thereon. As shown in FIG. 9B, a u-direction spatial code image and a v-direction spatial code image are acquired from captured images of the gray code patterns. Checker intersection coordinates are determined at a sub pixel precision on the camera-captured images, and projector image coordinates (u-direction spatial code value and v-direction spatial code value) corresponding to the checker intersection coordinates are determined.

Checker intersection coordinates: mc=(uc, vc)

Projector image coordinates: mp=(up, vp)

From the checker intersection coordinates and the projector image coordinates thus determined, three-dimensional coordinates M of checker intersections are determined. More specifically, a simultaneous equation of an expression showing the relationship between the camera coordinate system and the three-dimensional coordinate system, and an expression showing the relationship between the projector coordinate system and the three-dimensional coordinate system, is set. The three-dimensional coordinates are determined from the checker intersection coordinates (uc, vc) and the projector image coordinates $u_p$.

$$\begin{cases} s_c\tilde{m}_c = A_c[\,R_c \quad t_c]\tilde{M} \\ s_p\tilde{m}_p = A_p[\,R_p \quad t_p]\tilde{M} \end{cases} \qquad \text{Expression 20}$$

$$\begin{cases} s_c\begin{bmatrix} u_c \\ v_c \\ 1 \end{bmatrix} = \begin{bmatrix} c_{11} & c_{12} & c_{13} & c_{14} \\ c_{21} & c_{22} & c_{23} & c_{24} \\ c_{31} & c_{32} & c_{33} & c_{34} \end{bmatrix}\begin{bmatrix} X \\ Y \\ Z \\ 1 \end{bmatrix} \\ s_p\begin{bmatrix} u_p \\ v_p \\ 1 \end{bmatrix} = \begin{bmatrix} p_{11} & p_{12} & p_{13} & p_{14} \\ p_{21} & p_{22} & p_{23} & p_{24} \\ p_{31} & p_{32} & p_{33} & p_{34} \end{bmatrix}\begin{bmatrix} X \\ Y \\ Z \\ 1 \end{bmatrix} \end{cases} \qquad \text{Expression 21}$$

$$\begin{cases} (c_{11} - c_{31}u_c)X + (c_{12} - c_{32}u_c)Y + \\ \quad (c_{13} - c_{33}u_c)Z = c_{34}u_c - c_{14} \\ (c_{21} - c_{31}v_c)X + (c_{22} - c_{32}v_c)Y + \\ \quad (c_{23} - c_{33}v_c)Z = c_{34}u_c - c_{24} \\ (p_{11} - p_{31}u_p)X + (p_{12} - p_{32}u_p)Y + \\ \quad (p_{13} - p_{33}u_p)Z = p_{34}u_c - p_{14} \end{cases} \qquad \text{Expression 22}$$

$$\begin{bmatrix} c_{11} - c_{31}u_c & c_{12} - c_{32}u_c & c_{13} - c_{33}u_c \\ c_{21} - c_{31}v_c & c_{22} - c_{31}v_c & c_{23} - c_{31}v_c \\ p_{11} - p_{31}u_p & p_{12} - p_{32}u_p & p_{13} - p_{33}u_p \end{bmatrix}\begin{bmatrix} X \\ Y \\ Z \end{bmatrix} = \begin{bmatrix} c_{34}u_c - c_{14} \\ c_{34}u_c - c_{24} \\ p_{34}u_c - p_{14} \end{bmatrix} \qquad \text{Expression 23}$$

Where the above is represented as Q·V=F, when $Q^{-1}$ is present, the three-dimensional coordinates (X, Y, Z) are determined from $V=Q^{-1}\cdot F$. The affine transformation matrix $H_{R2P}$ usable to transform the determined three-dimensional coordinate values of the checker intersections into known coordinate values on the checker pattern is determined by a least square method. More specifically, the affine transformation matrix $H_{R2P}$, which is a 4×4 transformation matrix usable to transform three-dimensional coordinates $M_R$ in a measurement coordinate system of the camera 26 into three-dimensional coordinates $M_P$ in the printing coordinate system of the printing device 10, is determined.

$$\begin{aligned} &\tilde{M}_P = H_{R2P}\cdot\tilde{M}_R \\ &\tilde{M}_R = [X_R, Y_R, Z_R, 1]^T \\ &\tilde{M}_P = [X_P, Y_P, Z_P, 1]^T \end{aligned} \quad H_{R2P} = \left[\begin{array}{ccc|c} & R & & T \\ \hline 0 & 0 & 0 & 1 \end{array}\right] \qquad \text{Expression 24}$$

Specifically, n groups of $M_R$ and $M_P$ are applied to the following expression to find, by a nonlinear least square method (Levenberg-Marquardt method), the affine transformation matrix $H_{R2P}$ with which the value obtained by the following expression is minimized. In other words, "R" and "T" in the affine transformation matrix $H_{R2P}$ are determined.

$$\sum_{i=0}^{n} \left\| \tilde{M}_P - H_{R2P} \cdot \tilde{M}_R \right\|^2 \quad \text{Expression 25}$$

Herein, "R" is a 3×3 rotation matrix, and the number of element is "9". This is represented by three-dimensional vector r=[rx, ry, rz]T, and the degree of freedom is "3". In other words, the elements that are actual targets of optimization are three elements of rx, ry, and rz. During an optimization calculation performed by the nonlinear least square method, rx, ry, and rz are transformed into "R" by the following Rodrigues' formula. In the following formula, T is a three-dimensional translation vector, and the degree of freedom is "3".

$$R = \cos\theta I + (1 - \cos\theta) r r^T + \sin\theta \begin{bmatrix} 0 & -r_z & r_y \\ r_z & 0 & -r_x \\ -r_y & r_x & 0 \end{bmatrix} \quad \text{Expression 26}$$

Figure 10:
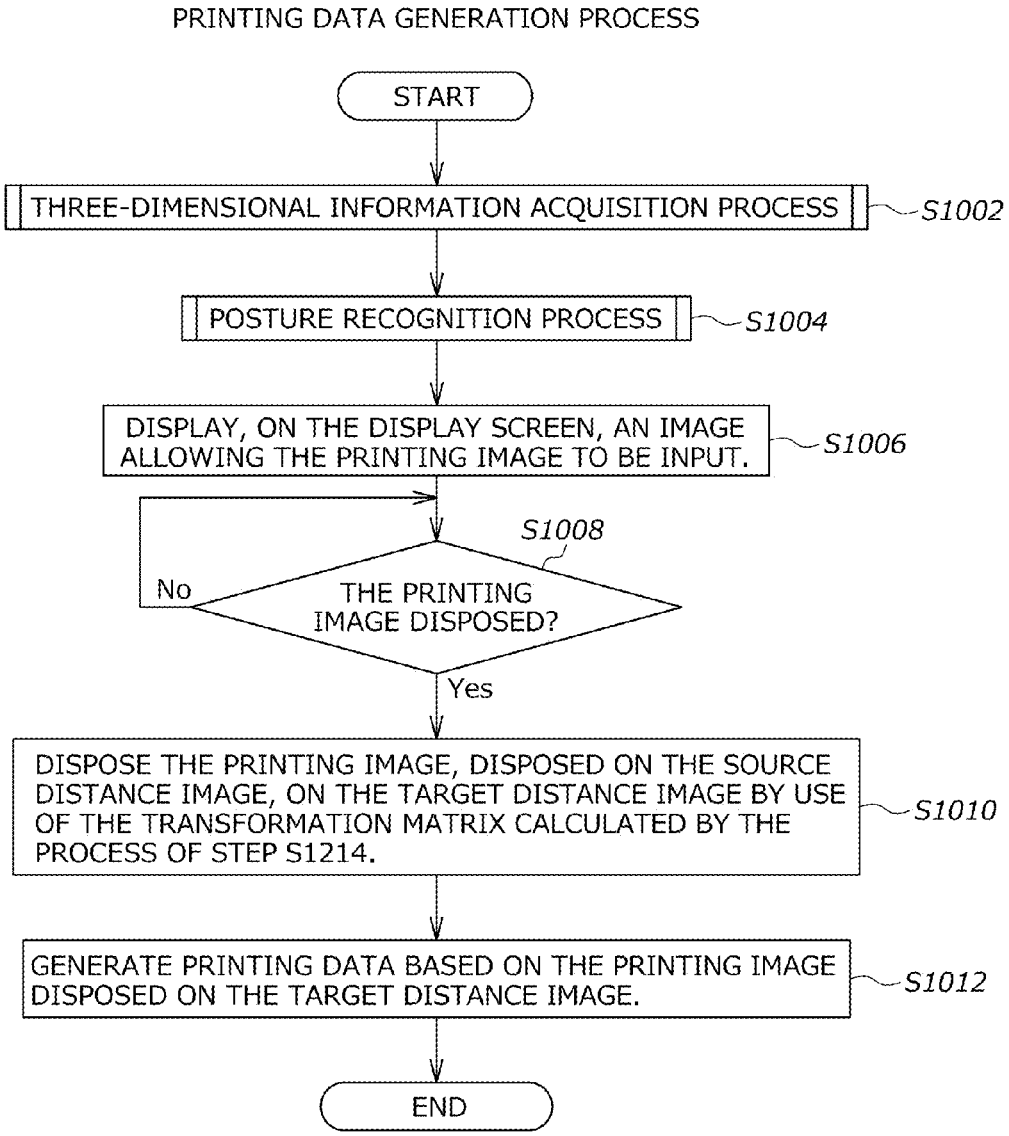
FIG. 10 is a flowchart showing a routine of a printing data generation process performed by the printing device according to a preferred embodiment of the present invention.

When the calibrations are finished, first, the operator places the plurality of printing subjects 200 on the top surface 14*a* of the table 14 such that the printing surface of each printing subject 200 faces an ink injection surface of the printing head 20. When the operator issues an instruction to generate printing data by, for example, pressing the operation button in this state, the microcomputer 300 starts a printing data generation process. FIG. 10 is a flowchart showing the printing data generation process in detail. In the printing data generation process, first, a three-dimensional information acquisition process is performed (step S1002).

Figure 11:
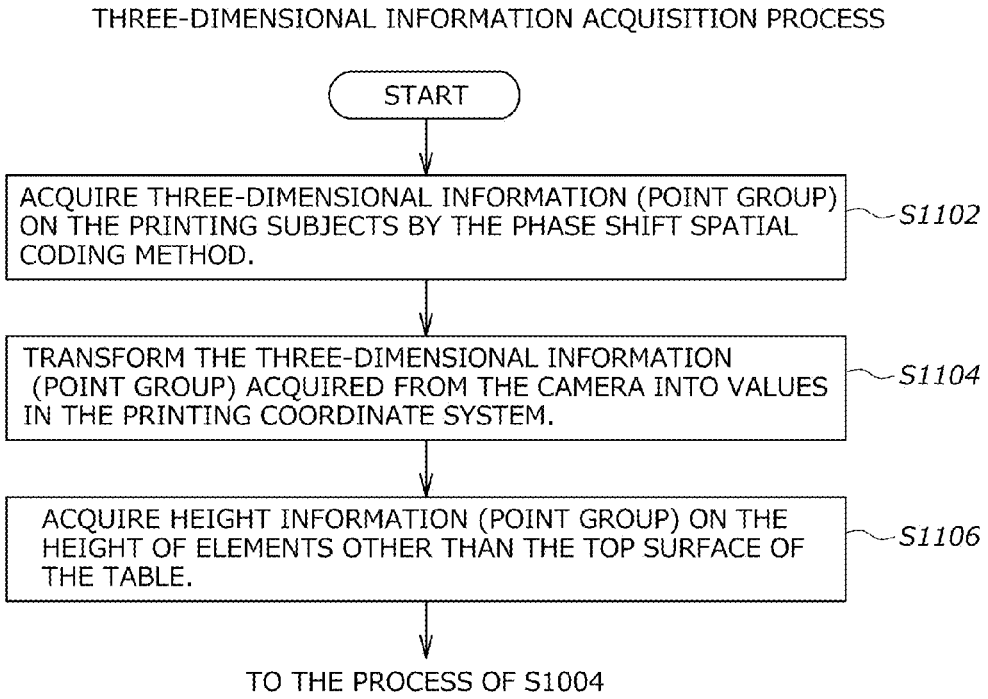
FIG. 11 is a flowchart showing a routine of a three-dimensional information acquisition process.

The three-dimensional information acquisition process is performed as shown in FIG. 11. First, three-dimensional information on each printing subject 200 is acquired by the phase shift spatial coding method (step S1102). By the process of step S1102, the three-dimensional information on each of the plurality of printing subjects 200 placed on the table 14 is acquired by the three-dimensional information acquirer 314.

Next, the acquired three-dimensional coordinates are transformed into values in the printing coordinate system (step S1104). By the process of step S1104, the three-dimensional coordinates in the camera coordinate system acquired by the process of step S1102 are transformed into values in the printing coordinate system by the point group data generator 316. Then, three-dimensional information on the height of elements other than the top surface 14*a* of the table 14, in other words, three-dimensional information representing only the printing surfaces of the printing subjects 200, is acquired (step S1106). Then, the process advances to step S1004 (described later). By the process of step S1106, point groups in the vicinity of (Z=0) on the top surface 14*a* of the table 14 are deleted to generate point group data representing only the printing subjects 200 by the point group data generator 316.

Figure 12:
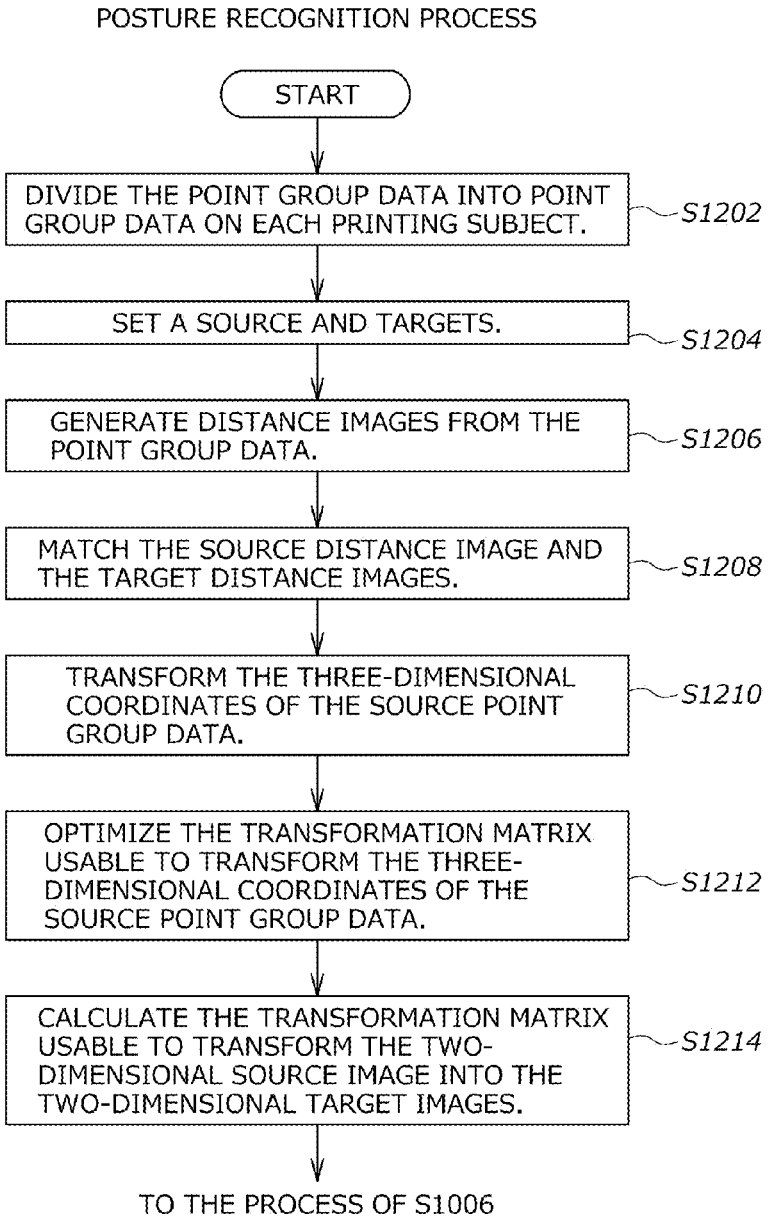
FIG. 12 is a flowchart showing a routine of a posture recognition process.

When the acquisition of the three-dimensional information on the printing subjects 200 is finished, a posture recognition process (step S1004) is performed to recognize the posture of each printing subject 200. FIG. 12 is a flowchart showing the posture recognition process in detail. The posture recognition process is performed as follows. First, the point group data acquired by the process of step S1002 is divided into a plurality of pieces of point group data each representing one printing subject 200 (step S1202). A reason for performing this is that the point group data acquired by the process of step S1002, which is three-dimensional information, does not show the printing subject 200 to which each point belongs. By the process of step S1202, the point group data, which is three-dimensional information representing the plurality of printing subjects 200 placed on the table 14, is divided to generate clusters each representing the printing subject 200 by the cluster generator 318. In this case, each cluster represents one printing subject 200.

Next, source point group data and target point group data are set (step S1204). In this case, one of the plurality of clusters is copied to be set as the source point group data, and all the clusters are each set as the target point group data, by the source point group data generator 320. When the setting of the source point group data and the target point group data is finished, distance images, each of which is two-dimensional information, are generated from the corresponding point group data, which is three-dimensional information (step S1206). By the process of step S1206, distance images, each of which is a two-dimensional image in which the Z coordinate is represented by a gray value, are generated from the source point group data and the target point group data by the distance image generator 322. Specifically, a source distance image is generated from the source point group data, and target distance images are each generated from the target point group data. The source distance image and the target distance images thus generated may be displayed on the display screen at this point.

Then, the source distance image and the target distance images are matched to each other (step S1208). By the process of step S1208, the source distance image is moved such that the center of gravity of the source distance image overlaps the center of gravity of each target distance image by the first transformation matrix calculator 324. After being moved, the source distance image is rotated one degree by one degree to acquire a normalized cross correlation for each target distance image. An angle at which the normalized cross correlation is highest is acquired as a rotation angle of the source distance image.

The first transformation matrix A33 usable to rotate the source distance image by the above rotation angle on each target distance image is calculated by the first transformation matrix calculator 324. Next, the three-dimensional coordinates of the source point group data are transformed (step S1210). By the process of step S1210, the first transformation matrix A33 is expanded to a 4×4 matrix for transformation of three-dimensional coordinates to acquire the transformation matrix A44 by the second transformation matrix calculator 326. The transformation matrix A44 is used to transform only a two-dimensional component of the three-dimensional coordinates of the source point group data, and thus the source point group data is made close to the target point group data.

Next, the transformation matrix usable to transform the three-dimensional coordinates of the source point group data is optimized (step S1212). By the process of step S1212, the transformation matrix AICP is calculated by use of the ICP algorithm, and the transformation matrix A44 and the transformation matrix AICP are multiplied to acquire the second transformation matrix A3D, by the second transformation matrix calculator 326. Then, the second transformation matrix A3D acquired by the process of step S1212 is used to calculate a transformation matrix usable to transform the source distance image (two-dimensional image) into the target distance image (two-dimensional image) (step S1214). Then, the process advances to step S1006. By the process of step S1214, the second transformation matrix A3D acquired by the process of step S1212 is used by the third transformation matrix calculator 328 to calculate the third transformation matrix usable to dispose the printing image, which is a two-dimensional image input onto the source distance image by the operator, on each target distance image in accordance with the position or posture of the corresponding printing subject 200.

When the posture recognition process is finished, an image that allows the printing image to be input by the operator is displayed on the display screen (step S1006). By the process of step S1006, the source distance image generated by the process of step S1206 is displayed on the display screen by the distance image generator 322 in a state where the printing image can be input by the operator. In other words, the source distance image is displayed in a state where the printing image can be disposed or edited by the operator. The operator disposes a desired printing image at a desired position or a desired angle on the source distance image displayed on the display screen. Such a printing image may be generated by the operator by use of predetermined software, or image data input beforehand may be used as such a printing image.

When the source distance image is displayed on the display screen, it is determined whether or not the printing image has been disposed on the source distance image by the operator (step S1008). Any of various techniques is usable to determine whether or not the printing image has been disposed on the source distance image by the operator. For example, a complete button usable to input information that the disposing of the printing image has been completed may be provided, and it may be determined that the disposing of the printing image has been finished by the complete button being clicked. When it is determined in the process of step S1008 that the printing image has not been disposed on the source distance image by the operator, the process of step S1008 is repeated.

By contrast, when it is determined in the process of step S1008 that the printing image has been disposed on the source distance image by the operator, the printing image disposed on the source distance image is disposed on each target distance image by use of the third transformation matrix calculated by the process of step S1214 (step S1010). In the case where the target distance image is set to be displayed on the display screen, a state where the printing image is disposed on the target distance image may be displayed by the process of step S1010.

Then, printing data is generated based on a plurality of the printing images disposed on each target distance image (step S1012), and the printing data generation process is finished. By the process of step S1012, the printing data is generated by the printing data generator 332 based on the plurality of printing images disposed on each target distance image.

After the printing data is generated in this manner, the operator issues an instruction to start the printing by, for example, pressing the operation button. When this occurs, the coordinate value representing a greatest height in the three-dimensional information acquired by the process of step S1104 (i.e., the highest Z coordinate value) is acquired, and the table 14 is moved in the Z-axis direction based on the coordinate value, by the Z-axis direction movement controller 312. More specifically, the table 14 is moved in the Z-axis direction such that the acquired Z coordinate value representing the greatest height and the Z coordinate value of the position of the printing head 20 (since the printing head 20 does not move in the Z-axis direction, the Z coordinate value of the print head 20 is kept the same) have a predetermined gap therebetween that allows the printing head 20 to perform the printing properly. When the position of the table 14 in the Z-axis direction is determined, the printing head 20 is moved in the X-axis direction and the Y-axis direction to perform the printing on the printing surface of each printing subject 200 based on the printing data, under the control of the controller 302.

As described above, the printing device 10 in this preferred embodiment acquires three-dimensional information on the plurality of printing subjects 200 placed on the table 14, and recognizes the position and posture of each printing subject 200 from the acquired three-dimensional information. From the acquired position and posture of each printing subject 200, the third transformation matrix is acquired that is usable to dispose the printing image, which is a two-dimensional image input onto the source distance image by the operator, on each printing subject 200 in accordance with the position and posture of the printing subject 200. When the operator disposes the printing image on the source distance image, the third transformation matrix is used to dispose the printing image on each target distance image. As a result, the printing image is disposed on each printing subject 200 for printing, regardless of the position or posture of the printing subject 200 placed on the table 14. Therefore, the work of determining the position of each printing subject 200 is made unnecessary, and thus the printing is performed easily. Since it is not necessary to produce a jig in accordance with the shape or size of the printing subject unlike with the conventional technology, the load on the operator is not increased. Since there is no cost of designing or producing the jig, the printing is performed at lower cost than with the conventional technology.

The above-described preferred embodiment may be modified as described in (1) through (6) below.

(1) In the above-described preferred embodiment, the printing device 10 preferably is an inkjet printer. The present invention is not limited to this. The printing device 10 may be any of various types of printers, such as a dot impact printer, a laser printer or the like.

Figure 13:
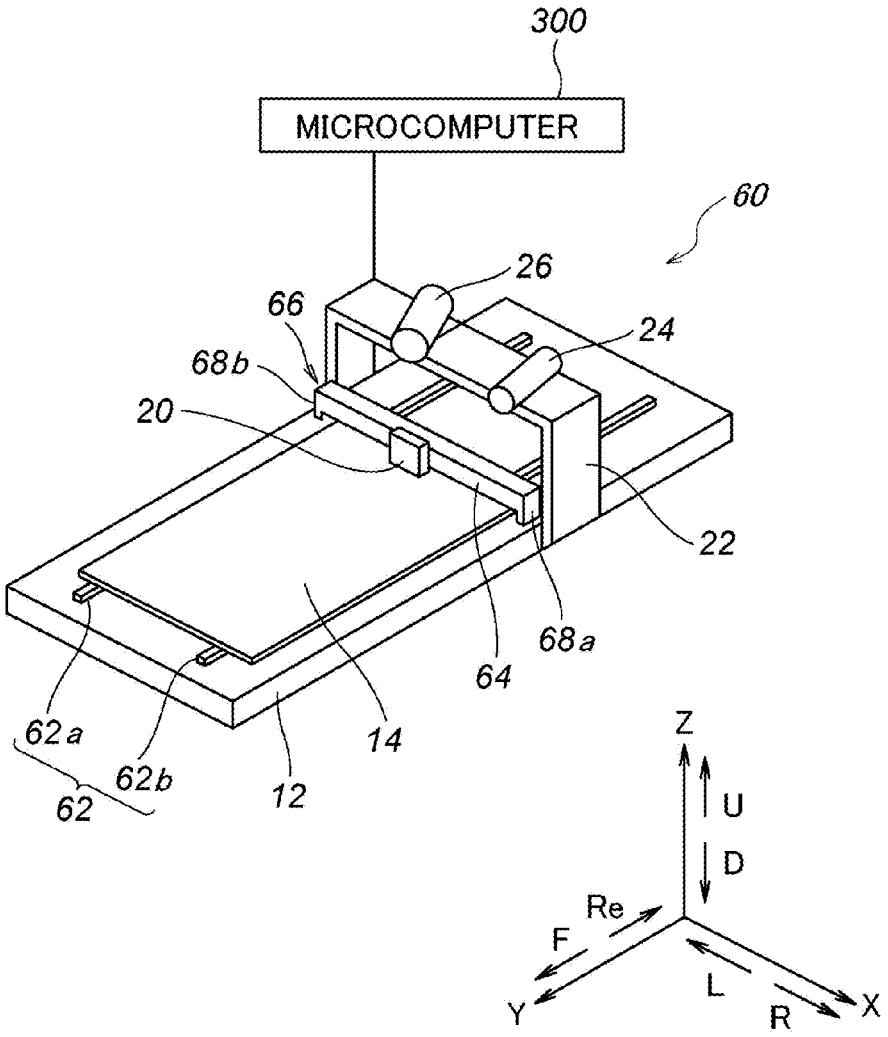
FIG. 13 shows a printing device according to a modification of a preferred embodiment of the present invention.

(2) In the printing device 10 in the above-described preferred embodiment, the printing head 20 preferably is movable in the X-axis direction along the rod-shaped member 16 included in the movable member 18 and is movable in the Y-axis direction by the movable member 18, whereas the table 14 preferably is movable in the Z-axis direction. The present invention is not limited to this. As shown in FIG. 13, the table 14 movable up and down in the Z-axis direction may be also movable in the Y-axis direction, whereas the printing head 20 may be movable in the X-axis direction. This will be described specifically. Unlike the printing device 10, a printing device 60 shown in FIG. 13 is structured as follows. The table 14 is provided so as to be slidable with respect to guide rails 62 located on the base member 12, and the printing head 20 is provided so as to be slidable with respect to a secured member 66, which is secured to the base member 12. The guide rails 62 include a pair of guide rails 62*a* and 62*b* extending in the Y-axis direction on the base member 12. The table 14 is provided with a driver (not shown) controllable by the microcomputer 300 such that the table 14 is movable in the Y-axis direction on the guide rails 62. As a result, the table 14 movable in the Z-axis direction is also movable in the Y-axis direction on the base member 12. The secured member 66 includes standing members 68*a* and 68*b* secured to the base member 12 and a rod-shaped member 64 extending in the X-axis direction so as to couple the standing members 68*a* and 68*b* to each other. The printing head 20 is located on the rod-shaped member 64 so as to be slidable with respect thereto in the X-axis direction. Because of this structure, the printing head 20 is movable in the X-axis direction along the secured member 66.

(3) In the above-described preferred embodiment, four printing subjects 200 preferably are placed on the table 14, and the printing is performed on the printing surface of each printing subject 200. The present invention is not limited to this. One, two, three, or five or more printing subjects 200 may be placed on the table 14 for printing. In the case where the printing is performed on one printing subject 200 placed on the table 14, the source point group data and the target point group data to be set are the same.

(4) In the above-described preferred embodiment, height information on the greatest height preferably is acquired from the three-dimensional information that is acquired by the three-dimensional information acquirer 314, and the table 14 is moved up and down by the Z-axis direction movement controller 312 based on the height information. The present invention is not limited to this. The height of the printing subjects 200 may be measured, so that the operator can move the table 14 up and down based on the result of the measurement. Alternatively, height information may be acquired from the three-dimensional information that is acquired by the three-dimensional information acquirer 314, and the amount by which the table 14 is to be moved up and down may be displayed on the display screen based on the height information, so that the operator can move the table 14 up and down by the amount displayed on the display screen.

(5) In the above-described preferred embodiment, the flatbed-type printing device 10 preferably includes the camera 26, the projector 24 and the microcomputer 300. The present invention is not limited to this. The camera 26, the projector 24 and the microcomputer 300 may be included in a printing device of a type different from the flatbed type.

(6) The above-described preferred embodiment and modifications described in (1) through (5) may be optionally combined.

The terms and expressions used herein are for description only and are not to be interpreted in a limited sense. These terms and expressions should be recognized as not excluding any equivalents to the elements shown and described herein and as allowing any modification encompassed in the scope of the claims. The present invention may be embodied in many various forms. This disclosure should be regarded as providing preferred embodiments of the principle of the present invention. These preferred embodiments are provided with the understanding that they are not intended to limit the present invention to the preferred embodiments described in the specification and/or shown in the drawings. The present invention is not limited to the preferred embodiments described herein. The present invention encompasses any embodiments including equivalent elements, modifications, deletions, combinations, improvements and/or alterations which can be recognized by a person of ordinary skill in the art based on the disclosure. The elements of each claim should be interpreted broadly based on the terms used in the claim, and should not be limited to any of the preferred embodiments described in this specification or referred to during the prosecution of the present application.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A printing device that acquires three-dimensional information on at least one printing subject having a three-dimensional shape and prints a predetermined printing image as a two-dimensional image on the at least one printing subject, the printing device comprising:

a table that allows the at least one printing subject to be placed thereon;

a projector that projects a predetermined pattern to the at least one printing subject placed on the table;

an image generator that captures an image of the at least one printing subject having the predetermined pattern projected thereon;

a three-dimensional information acquirer that acquires a spatial code image from the image captured by the image generator and acquires the three-dimensional information on the at least one printing subject from the acquired spatial code image;

a recognizer that recognizes a position and a posture of each of the at least one printing subject from the acquired three-dimensional information;

a disposer that disposes the printing image on each of the at least one printing subject in accordance with the position and the posture thereof; and a printing data generator that generates printing data representing the printing image disposed by the disposer.

2. A printing device according to claim 1, further comprising:

a printing head that performs printing on the at least one printing subject; and an adjuster that acquires height information on a greatest height of the at least one printing subject from the three-dimensional information and adjusts a gap between the table and the printing head by use of the acquired height information.

3. A printing device according to claim 1, wherein:

the projector projects a binary pattern as the predetermined pattern to the at least one printing subject while shifting the binary pattern;

the image generator captures an image of the projected binary pattern each time the binary pattern is shifted; and the three-dimensional information acquirer acquires a phase shift image formed by synthesis of the images of the binary pattern captured each time the binary pattern is shifted, and acquires the three-dimensional information from a synthesis image formed by synthesis of the acquired phase shift image and the spatial code image.

4. A printing device according to claim 1, wherein the at least one printing subject includes a plurality of printing subjects, and the recognizer includes:

a divider that divides point group data as the three-dimensional information on the plurality of printing subjects placed on the table into a plurality of pieces of point group data, each of which represents one of the plurality of printing subjects;

a setter that sets, as first point group data, point group data on one of the plurality of printing subjects onto which the printing image is allowed to be input by an operator, among the plurality of pieces of point group data, and sets each of all the plurality of pieces of point group data as second point group data;

a distance image generator that generates a first distance image as two-dimensional information from the first point group data, and generates a second distance image as two-dimensional information from the second point group data;

a first calculator that calculates a first transformation matrix usable to make the first distance image close to the second distance image;

a second calculator that expands the first transformation matrix into a transformation matrix usable to perform transformation into three-dimensional coordinates, and calculates a second transformation matrix usable to transform the first point group data such that the first point group data is made close to the second point group data; and a third calculator that calculates, from the second transformation matrix, a third transformation matrix usable to dispose the printing image, input onto the first distance image, on the second distance image; and the disposer transforms the printing image on the first distance image by use of the third transformation matrix and disposes the printing image on the second distance image.

5. A printing device according to claim 2, wherein the printing head is an ink head that injects ink by an inkjet system.

6. A printing device according to claim 4, wherein to calculate the first transformation matrix, the first calculator moves the first distance image such that a center of gravity of the first distance image overlaps a center of gravity of the second distance image, and rotates the first distance image in units of a predetermined angle such that the first distance image is close to the second distance image.

7. A printing method by which three-dimensional information on at least one printing subject having a three-dimensional shape that is placed on a table is acquired, and a predetermined printing image as a two-dimensional image is printed on the at least one printing subject, the printing method comprising:

projecting a predetermined pattern onto the at least one printing subject placed on the table;

capturing an image of the at least one printing subject having the predetermined pattern projected thereon;

acquiring a spatial code image from the captured image, and acquiring the three-dimensional information on the at least one printing subject from the acquired spatial code image;

recognizing a position and a posture of each of the at least one printing subject from the acquired three-dimensional information;

disposing the printing image on each of the at least one printing subject in accordance with the position and the posture thereof; and generating printing data on the printing image disposed on the at least one printing subject.

8. A printing method according to claim 7, further comprising:

acquiring height information on a greatest height of the at least one printing subject from the three-dimensional information; and adjusting, by use of the acquired height information, a gap between the table and a printing head that performs printing on the at least one printing subject.

9. A printing method according to claim 7, wherein:

a binary pattern as the predetermined pattern is projected onto the at least one printing subject while being shifted;

an image of the projected binary pattern is captured each time the binary pattern is shifted; and a phase shift image formed by synthesis of the images of the binary pattern captured each time the binary pattern is shifted is acquired, and the three-dimensional information is acquired from a synthesis image formed by synthesis of the acquired phase shift image and the spatial code image.

10. A printing method according to claim 7, wherein:

the at least one printing subject includes a plurality of printing subjects;

point group data as the three-dimensional information on the plurality of printing subjects placed on the table is divided into a plurality of pieces of point group data, each of which represents one of the plurality of printing subjects;

point group data on one of the plurality of printing subjects onto which the printing image is allowed to be input by an operator, among the plurality of pieces of point group data, is set as first point group data, and each of all the plurality of pieces of point group data is set as second point group data;

a first distance image as two-dimensional information is generated from the first point group data, and a second distance image as two-dimensional information is generated from the second point group data;

a first transformation matrix usable to make the first distance image close to the second distance image is calculated;

the first transformation matrix is expanded into a transformation matrix usable to perform transformation into three-dimensional coordinates, and a second transformation matrix usable to transform the first point group data such that the first point group data is made close to the second point group data is calculated; and a third transformation matrix usable to dispose the printing image, input onto the first distance image, on the second distance image is calculated from the second transformation matrix; and the printing image on the first distance image is transformed by use of the third transformation matrix, and the printing image is disposed on the second distance image.

11. A printing method according to claim 8, wherein the printing head is an ink head that injects ink by an inkjet system.

12. A printing method according to claim 10, wherein, to calculate the first transformation matrix, the first distance image is moved such that a center of gravity of the first distance image overlaps a center of gravity of the second distance image, and the first distance image is rotated in units of a predetermined angle such that the first distance image is close to the second distance image.

* * * * *